United States Patent [19]

Lindahl

[11] Patent Number: 5,000,823

[45] Date of Patent: Mar. 19, 1991

[54] METHOD AND APPARATUS FOR THE PROCESSING OF GROUNDWOOD PULP TO REMOVE COARSE PARTICULATE LIGNOCELLULOSIC MATERIAL

[75] Inventor: Jonas A. I. Lindahl, Domsjo, Sweden

[73] Assignee: Mo och Domsjo Aktiebolag, Ornskoldsvik, Sweden

[21] Appl. No.: 844,905

[22] Filed: Mar. 27, 1986

Related U.S. Application Data

[63] Continuation of Ser. No. 301,714, Sep. 14, 1981, abandoned, which is a continuation-in-part of Ser. No. 246,558, Mar. 23, 1981, abandoned.

[30] Foreign Application Priority Data

Mar. 25, 1980 [SE] Sweden ..... 802269

[51] Int. Cl.[5] ..... B02C 23/28; D21C 1/30; D21D 1/34

[52] U.S. Cl. ..... 162/28; 162/49; 162/254; 162/258; 241/28

[58] Field of Search ..... 162/28, 261, 254, 258, 162/198, 263.61, 20, 49; 241/28

[56] References Cited

U.S. PATENT DOCUMENTS

| | | | |
|---|---|---|---|
| 2,934,278 | 4/1960 | Roberson | 241/28 |
| 3,816,241 | 6/1974 | Blume | 162/198 |
| 4,207,139 | 6/1980 | Haikkala | 162/28 |
| 4,257,563 | 3/1981 | Henrich | 241/28 |
| 4,280,868 | 7/1981 | Hoglund et al. | 162/28 |

FOREIGN PATENT DOCUMENTS

| | | |
|---|---|---|
| 2812299.8 | 9/1979 | Fed. Rep. of Germany . |
| 7902493-1 | 3/1979 | Sweden . |

OTHER PUBLICATIONS

Moore, "Refiner Control–Working Group Report", *Paper Technology and Industry*, Sept. 1979; pp. 265–258.

MacDonald et al., *Pulp & Paper Manufacture* Second Ed., vol. III, pp. 150–155, New York, 1970.

*Primary Examiner*—Steve Alvo

[57] ABSTRACT

Coarse wood residues, slivers and shives present in groundwood pulp as obtained in grinders are removed by passing a uniform flow of the pulp suspension containing coarse wood residues and shives from the grinder to a conical crushing and beating refiner having two treatment zones with a stationary part and a rotary part for reducing all wood material present in the suspension to free fibers, while measuring and controlling the freeness of the pulp within selected limits by controlling both the power input to the grinder and the power input to the conical crushing and beating refiner, and the degree of beating of the pulp, obtaining groundwood pulp having a low shives content and superior strength properties, at a low energy consumption.

24 Claims, 2 Drawing Sheets

METHOD AND APPARATUS FOR THE PROCESSING OF GROUNDWOOD PULP TO REMOVE COARSE PARTICULATE LIGNOCELLULOSIC MATERIAL

Common groundwood pulp is produced at atmospheric pressure by pressing debarked pulpwood logs against a rotating cylindrical stone. Exemplary of such processes are Offenlegungsschrift No. 2,336,350 and Norwegian patent No. 33,951. The intense heat generated during the grinding results in a vigorous heating up of the grindstone and the wood material. The area of contact between wood and stone is called the grinding zone. To control the heating in the grinding zone, large volumes of water are added. Besides the cooling or temperature-regulating effect in the grinding zone, the water has another important function, and that is, to wash the grindstone surface clean of loose pulp fibers. For this reason, the water is usually applied as a spray or shower to the grindstone, and is referred to as shower water.

While the water is intended for cooling, it has been considered that a grinding at high temperatures is beneficial, and therefore the shower water is warm, and as a rule has a temperature of at least 65° C. This is because it has been found that to carry out the grinding of debarked pulpwood logs in the production of groundwood pulp at elevated temperatures reduces the energy requirement for the grinding, and facilitates defibration. It has also been suggested that it is especially advantageous to carry out the grinding under superatmospheric pressure in the presence of steam or air at an elevated temperature, since this further reduces energy consumption, and increases the tear resistance of the resulting pulp, as well as the freeness and bulk of the pulp produced.

Swedish patent Nos. 318,178 and 336,952, and U.S. Pat. No. 3,808,090, patented Apr. 30, 1974 to Logan and Luhde, describe a method for the defibration of pulpwood logs by subjecting the material to grinding under a superatmospheric pressure of inert gas while supplying water at at least 71° C. and preferably about 99° C. during the grinding. This process is said to provide a groundwood pulp having a better drainability and improved tear resistance, while the energy consumption is less than that normally required in the preparation of groundwood pulp.

However, it has been found that this process has numerous disadvantages. The brightness is unsatisfactorily low, by present-day standards, only about 48 to 54% GE being obtained, according to Table I, page 4 of the patent. If bleaching chemicals are added to the shower water, the brightness is not noticeably improved, being within the range from about 38 to about 55% GE, even though very large amounts of bleaching chemicals are added. Tensile strength, although better than for ordinary groundwood pulp, as well as tear index and smoothness, are not as high as would be desirable.

U.S. Pat. No. 4,029,543 to Lindahl, patented June 14, 1977, provides a process for the preparation of peroxide-bleached, mechanical cellulose pulps of improved brightness and strength. A mechanical freeing of the fibers is provided for instance by bringing the wood in the form of logs into contact with the surface of a rotating grindstone (groundwood) or grinding the wood in the form of chips in a disc refiner (refiner pulp). One further type of mechanical freeing can also be made in a so-called FROTAPULPER ®, which is an apparatus principally consisting of two screws, which knead the wood material which is present in the form of large splinters, knots, etc. In mechanical freeing of the fibers the pulp will contain all components of the original wood with the exception of the water-soluble material.

The process is characterized by the fact that the mechanical freeing of the fibers is carried out in the presence of only spent liquor from the peroxide bleaching step, said liquor having a pH higher than 7.

The effect obtained is high brightness, improved strength and decreased consumption of chemicals.

In U.S. Pat. No. 4,207,140, patented June 10, 1980, to Lindahl, energy requirements are further reduced and the quality of the groundwood pulp improved by grinding debarked pulpwood logs under a superatmospheric pressure of a gas selected from the group consisting of steam, air, and steam and air, while continuously supplying thereto water comprising spent bleaching liquor at a temperature of at least 70° C. and forming a pulp suspension in the resulting aqueous liquor; centrifugally separating steam from the the pulp supsension and using the separated hot steam to heat the spent bleaching liquor supplied to the grinding; thickening the pulp suspension to a concentration within the range from about 5 to about 40% and supplying water separated therefrom to the grinding; diluting the pulp suspension to a concentration within the range from about 0.5 to about 4.0%; screening the pulp suspension; thickening the pulp suspension to a concentration within the range from about 10 to about 50% and supplying water separated therefrom to the screening; adding bleaching chemicals thereto and bleaching the pulp, diluting the bleached pulp with spent bleaching liquor to a concentration within the range from about 1 to about 6%; thickening the bleached pulp suspension to a concentration within the range from about 10 to about 50%; separating, heating and recycling to the grinding spent bleaching liquor containing residual bleaching chemicals.

The resulting groundwood pulp not only is obtained at a considerably lower energy consumption, but has substantially improved strength as well as greatly improved brightness, extending to as high as 80% SCAN. The groundwood pulp also has a very high content of flexible fibers, making possible the manufacture of paper with a lower grammage and a lower roughness than has heretofore been possible with groundwood pulps.

In U.S. Pat. No. 4,207,139, patented June 10, 1980, to Lindahl and Haikkala, energy requirements in the production of groundwood pulp are further reduced and the quality of the pulp improved, including in particular, brightness and strength, by grinding debarked pulpwood logs under a superatmospheric pressure of a gas selected from the group consisting of steam, air and steam and air, while continuously supplying thereto process white water and water separated in thickening groundwood pulp suspension at a temperature within the range from about 75° to about 100° C., and forming a pulp suspension in the resulting aqueous liquor; centrifugally separating steam from the pulp suspension, and using the separated steam to heat the water supplied to the grinding; thickening the pulp suspension to a pulp concentration within the range from about 5 to about 40% and supplying water separated therefrom to the grinding; diluting the thickened pulp, and screening the diluted pulp suspension; thickening the screened rejects suspension to a pulp concentration of at least 10%, and defibrating the screened rejects suspension in a refiner; recycling the screened rejects suspension to the from-steam-separated pulp suspension; and mixing the thickened and refined rejects suspension, having a pulp concentration of at least 8%, with the pulp suspension, thereby increasing the pulp concentration of the from-steam-separated pulp suspension, and thus facilitating its thickening.

The process makes it possible to produce groundwood pulp while consuming much less energy than in the normal procedures for grinding lignocellulosic material. The groundwood pulp has a greater brightness and an improved strength (as compared with the known groundwood pulps), which make it particularly suitable for use in the manufacture of paper. Paper having a greater quality range can be obtained from the groundwood pulps in accordance with the invention.

The processes according to the prior art have several drawbacks. One disadvantage with grinding at atmospheric pressure and with grinding at superatmospheric pressure is that large volumes of shower water are required. Thus, the shower water mixed into the pulp amounts to from 40 to 200 parts per part of pulp. This means that a very dilute pulp suspension is discharged from the grinding, containing only from 0.5 to 2.5% by weight of pulp.

Consequently, the volume of discharged pulp suspension is very large. If for instance one has several grinders, the pulp collection tank must be very large. Furthermore, unnecessarily great quantities of energy are consumed for the transport of the dilute pulp suspension, since this mainly consists of water. A low pulp concentration is also a disadvantage if the pulp later on has to be thickened and/or bleached. In the thickening operation, costly large volume drum filters as a rule must be used, and if the pulp is to be bleached a dewatering operation must be carried out in some sort of press.

The groundwood pulp suspension leaving the grinder also contains coarse wood residues, and to remove these a splinter crusher has to be interposed at the outlet of the grinder.

Swedish patent application No. 79-02493-1 also arranges a splinter crusher in the closed discharge line from the grinder pit. During the grinding occasionally coarse splinters are set free and log residues remain which in certain cases may have the full length of a log. These pieces cause stoppage in the discharge line. Through the insertion of a splinter crusher ahead of the discharge line the disturbing splinters and log residues will be reduced in size and may with that be discharged together with the groundwood pulp. The splinter crusher can comprise a rotating cylinder having several side-by-side arranged discs equipped with tooth or knife-resembling means which cylinder cooperates with stators, likewise equipped with tooth or knife-resembling means. The patentees note that it is in this case advantageous, if the separate tooth or knife-resembling means on the discs are arranged at an angular displacement between each other. Through this measure a long log residue will be prevented from entering the cutting zone, but will be slowed down, whereby jamming is prevented and energy is saved.

U.S. Ser. No. 097,466, filed Nov. 26, 1979, now U.S. Pat. No. 4,324,612, patented Apr. 13, 1982 to Lindahl provides a process for the preparation of groundwood pulp from debarked pulpwood logs, which comprises grinding the logs in the presence of water under a superatmospheric pressure of a gas selected from the group consisting of steam, air, and steam and air, and forming and discharging a pulp suspension in the resulting aqueous liquor, while continuously supplying water during the grinding in a volume of less than 35 parts per part of bone dry pulp at a rate of addition such that the temperature of the discharged pulp suspension is below 200° C. and preferably below 180° C. and within the range from about 1.5 to about 50, preferably from 2 to 8, times the temperature in °C. of the added water at a pressure within the range from about 8 to about 40 kilopounds/cm$^2$, preferably from 10 to 30 kiloponds/cm$^2$, higher than the superatmospheric pressure and at a temperature within the range from about 2° to about 63° C.; then, optionally, any one or more of the steps of centrifugally separating steam from the pulp suspension and using the separated hot steam for heating purposes; thickening the pulp suspension within the range from about 8 to about 50% and supplying water separated therefrom to the grinding; and adding bleaching chemicals to the pulp and bleaching the pulp; the groundwood pulp is obtained in a higher pulp concentration and at considerable saving in energy, can be used with or without bleaching, and has a high content of long flexible fibers.

The resulting pulp concentration in the pulp suspension discharged from the grinder exceeds 2.9%, which is higher than normal. Not only is it possible to produce a groundwood pulp suspension having a considerably reduced water content, but at the same time the energy consumption during the process is considerably lower. This result contradicts prior practice, in which large amounts of hot shower water are always added to the grinder.

In all of these processes, those fibers which are freed from the wood are collected with the shower water in a pit located at the bottom of the grinder. The problem is, however, that in many cases it is not possible to grind every log or wood block completely. Thus, there normally are collected with the fibers wood residues which may be of considerable size, with lengths of up to one meter and thicknesses of several centimeters, reaching occasionally to as much as 10 centimeters. The concentration of dry solids in the resultant pulp suspension normally varies between 0.4 and 2%.

In conventional grinders, the coarse log or wood residues that do not float off with the pulp suspension remain on the bottom of the grinder pit, and must be removed manually. The development of grinders which operate under superatmospheric pressures has provided means for automatically removing the wood residues, which then pass with the pulp suspension to a splinter crusher for reducing the size of the wood residues to slivers, which are often of the size of a conventional match stick. In order to reduce the slivers to fiber form, it is first necessary to screen the pulp suspension, in order to work up the slivers, after which the slivers and the coarsest part of the pulp, the so-called rejects, are passed to a disc refiner, in which they are defibrated to individual fibers.

Wood residues discharged manually from conventional grinders are also normally passed to a crusher. In order to separate such wood residues and slivers which accompany the pulp suspension from the outlet of the grinder pit, it is necessary to pass the pulp suspension through a vibratory screen, from which the rejects are also passed to the crusher. The pulp is then screened again and the rejects are fed to a disc refiner, for fiber separation.

The recovery of coarse wood residues in the manufacture of groundwood pulp is thus a relatively complicated procedure.

A further problem is that the groundwood pulp properties vary with the condition of the grindstone. A grindstone which has been used over a relatively long period of time gives a pulp with low freeness while the energy consumed is relatively high. Thus, eventually a grindstone which has been long in use must be resharpened. This is done with a special tool, a burr lathe, which imparts to the stone a rough surface with a grooved pattern. A newly sharpened stone, however, often imparts to the pulp an undesirably high freeness, while the mechanical strength is relatively low. It is thus difficult to obtain a pulp of uniform quality.

In order to obtain groundwood pulp of uniform quality the freeness of the pulp and the grinding conditions have to be closely controlled. Since there is no way of assuring that every log fed to the grinder will be ground completely, coarse log or wood residues continuously appear in the pulp suspension, and pose serious difficulties, since they have had to be handled manually, by way of a complicated crushing-screening-refining process. Even so, it is still difficult to obtain groundwood pulp of uniform quality.

The present invention avoids these problems by passing the groundwood suspension obtained in the grinder with the coarse wood residues and slivers present in said suspension continuously to a conical crushing and beating refiner in which all the wood present in the suspension is successively reduced to separate free fibers, while measuring and automatically regulating freeness of the defibrated pulp to within predetermined limits by means of a freeness-measuring device equipped with a transducer which controls the power input to the grinder, the power input to the conical crushing and beating refiner and, in addition, the extent to which the suspension is finely ground in the conical crushing and beating refiner.

The process in accordance with the invention comprises passing a uniform flow of the pulp suspension containing coarse wood residues and shives from the grinder to a conical crushing and beating refiner having two treatment zones with a stationary part and a rotary part for reducing all wood material present in the suspension to free fibers, while measuring and controlling the freeness of the pulp within selected limits by controlling both the power input to the grinder and the power input to the conical crushing and beating refiner, and the degree of beating of the pulp, obtaining groundwood pulp having a low shives content and superior strength properties, at a low energy consumption.

In the process of the invention, it is possible to reduce without difficulty all the log or wood residues present in the suspension to free fiber form, irrespective of the size of the residues, and to obtain at the same time a pulp of uniform quality, due to control of the power load on the grinder and on the conical crushing and beating refiner. Further adjustments can be made in the peripheral clearances of the conical crushing and beating refiner. It is even possible to break up and beat long and relatively coarse wood residues without disturbing production rate.

It is also possible when practicing the invention to decrease and adjust the freeness of the pulp with a relatively moderate power input, a surprising and significant advantage.

It is also possible to manufacture groundwood pulp having a low freeness value using a newly sharpened grindstone. The surprisingly high strength properties of the groundwood pulp produced by means of the invention must also be considered an advantage afforded by the invention.

Important savings in energy are obtained when grinding under superatmospheric pressure by using steam released in the cyclone for heating purposes or for generating electrical energy. There is also a decrease in the total energy consumed in the manufacturing process, compared with the energy consumed in previously known techniques.

The invention accordingly provides a process for removing coarse wood residues and shives from aqueous groundwood pulp suspensions obtained in a grinder, which comprises passing a uniform flow of groundwood pulp suspension containing coarse wood residues and shives from the grinder to a conical crushing and beating refiner having two treatment zones, including a stationary part and a rotary part defining therebetween a confined conical crushing zone and a beating zone; and in said zones reducing coarse wood residues and shives in the suspension to free fibers while measuring and controlling the freeness of the pulp within selected limits by controlling both the power input to the grinder and to the crushing and beating refiner and the degree of beating of the pulp, thereby obtaining groundwood pulp having a low shives content and superior strength properties at a low energy consumption.

The invention also provides apparatus for reducing to free fibers coarse wood residues and shives present in aqueous groundwood pulp suspensions which comprises:

(1) a grinder for preparing groundwood pulp from wood and comprising a grindstone;

(2) a conical crushing and beating refiner having two treatment zones with a stationary part and a rotary part defining therebetween a confined conical crushing zone and a beating zone for reducing wood material present in the suspension to free fibers;

(3) means for passing a uniform flow of the pulp suspension containing coarse wood residues and shives from the grinder;

(4) means for measuring the freeness of the pulp; and (5) means for controlling the freeness of the pulp within selected limits by controlling both the power input to the crushing and beating refiner and the degree of beating of the pulp; thereby producing groundwood pulp having a low shives content and superior strength properties at a low energy consumption.

BRIEF DESCRIPTION OF THE DRAWINGS

Preferred embodiments of the process and apparatus of the invention are shown in the drawings, in which.

Figure 1:
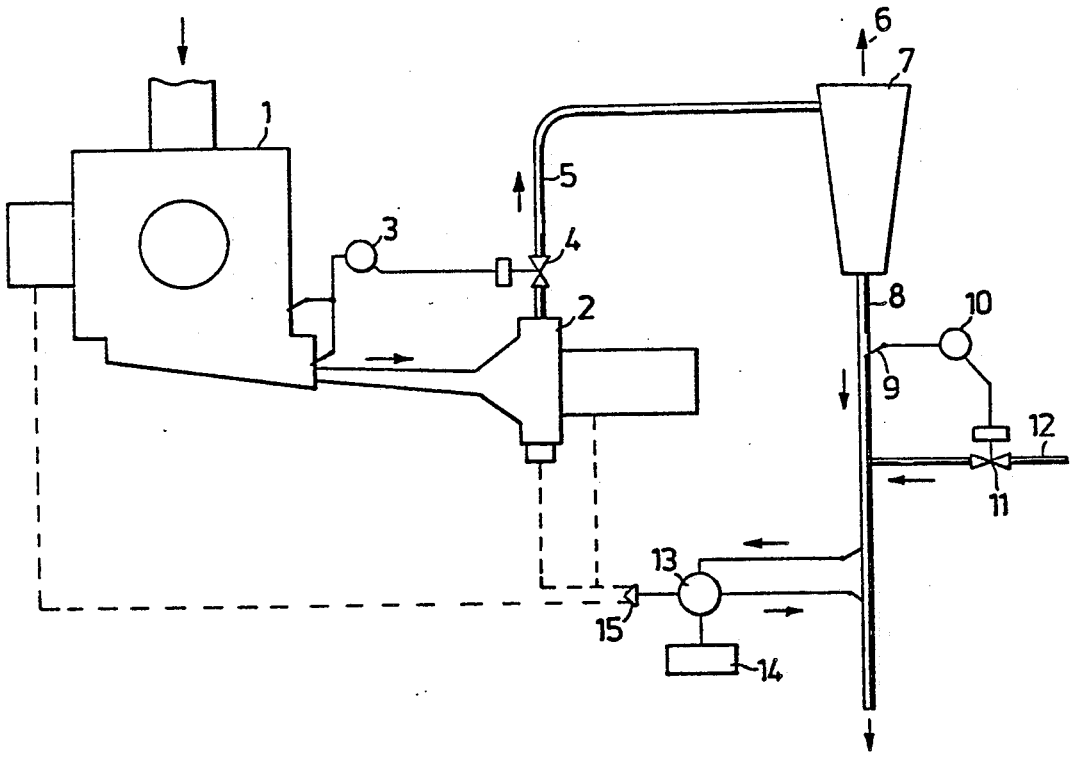
FIG. 1 is a flow sheet showing a preferred embodiment of the process according to the invention.

The flow sheet of FIG. 1 shows a system utilizing a pressure grinder 1 feeding superatmospheric groundwood pulp suspension directly into a conical crushing and beating refiner 2, in which coarse wood residues, slivers and shives are reduced to fiber form. The pulp suspension in the outlet zone 1*a* of the grinder is continuously maintained at substantially the same level with the aid of differential pressure sensor 3, arranged to regulate the opening of the outlet valve 4 incorporated in the outlet line 5 of the conical crushing and beating refiner. The line 5 leads to a cyclone 7, with an outlet 6 for steam separated from the pulp suspension, and an outlet line 8. The outlet line 8 is provided with a sensor 9 for determining the pulp consistency, and an associated pulp consistency measuring and control unit 10, which, in turn, regulates an inlet feed valve 11 in a diluting-water line 12, to thin the pulp suspension as necessary, so as to maintain a constant pulp consistency.

A part of the flow of the pulp suspension in line 8 from the cyclone 7, after adjustment of pulp consistency if necessary to maintain it constant, is passed via line 16 to an automatic freeness tester 13, where the freeness values of the pulp suspension are recorded on a recorder 14. This flow is then returned to line 8 via line 17.

The transducer 15 then utilizes information from the freeness values to control power input to the grinder 1 and to the conical crushing and beating refiner 2 with its two treatment zones, the crushing zone 2*a* and the beating zone 2*b*.

Figure 2:
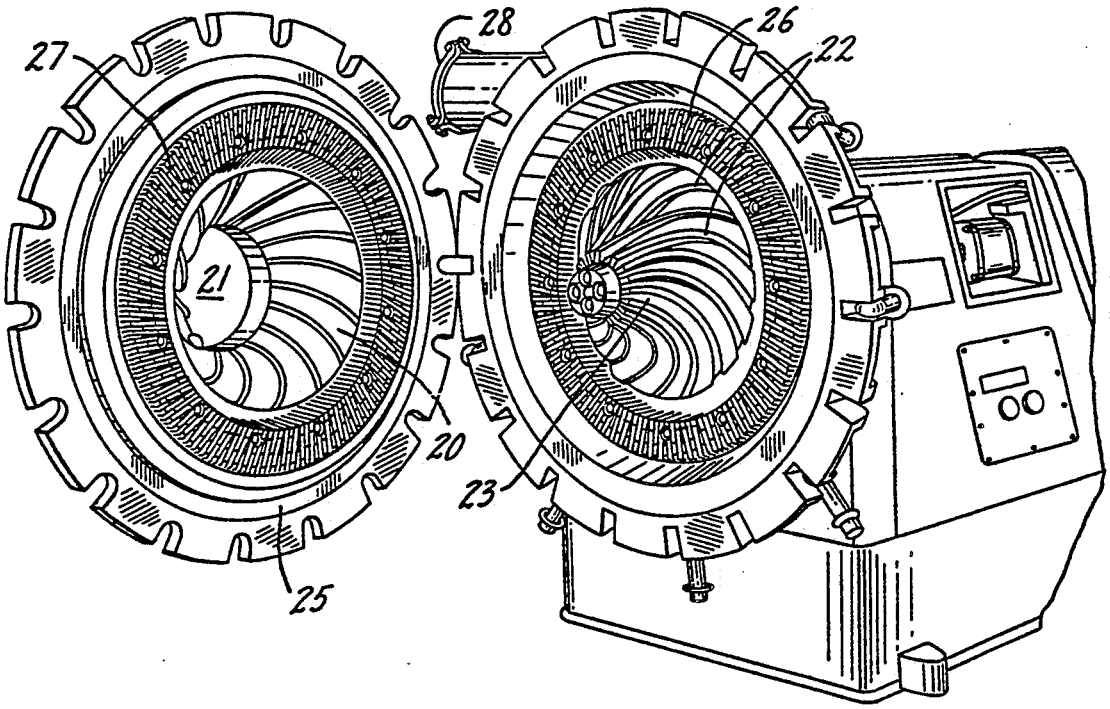
FIG. 2 is an exploded view of one form of conical refiner of the apparatus of the invention.
Figure 3:
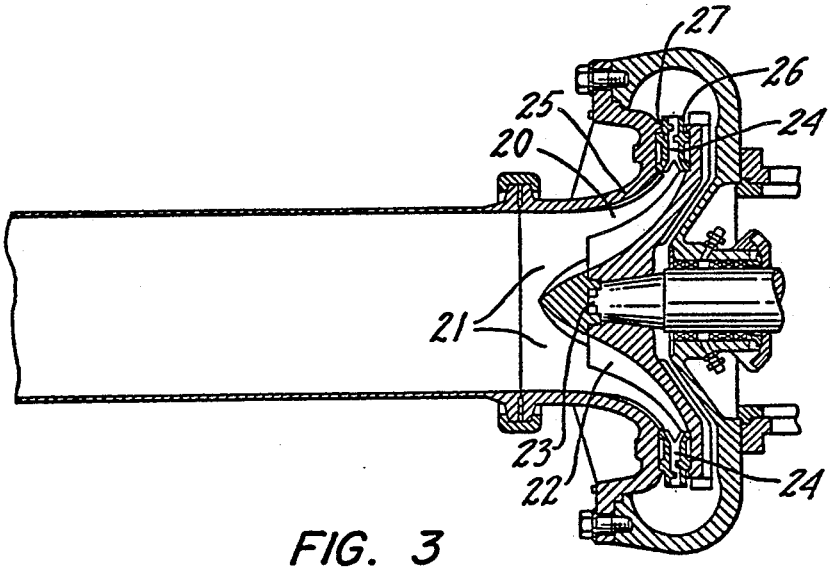
FIG. 3 is a longitudinal section through the conical refiner of FIG. 2.

The conical crushing and beating refiner 2 shown in FIG. 1 can be that of FIGS. 2 and 3. Conical refiners have two treatment zones, an introductory crushing zone in which coarse wood residues and shives are successively broken up (pre-defibrated) to fibrous particles of equal size, and a beating zone in which the fibrous particles of equal size arriving from the crushing zone are beaten (defibrated) to separate free fiber form. The conical crushing and beating refiner comprises a stator and a rotor which define the crushing and beating zones therebetween, and which at their peripheral end portions in the beating zone merge with planar, annular beater discs having a narrowing, adjustable clearance therebetween. The rotor in the portions within the crushing zone has the form of a concave cone, having on the surface thereof radially or elongated helically extending projections or bars which intermesh with similar elongated projections or bars on the stator surface.

The refining of the coarse wood residues in a conical refiner is thus achieved by causing the coarse material to pass between the elongated projections or bars on the stator and rotor surfaces, which are sufficiently close together to shorten, flex and/or bruise the individual coarse residues. The type of action depends upon variables such as the peripheral speed and clearance between the stator and rotor, and the arrangement of the elongated projections or bars on the surfaces of the rotor and the stator.

The pulp suspension containing coarse wood residues and shives enters at the end with the widest clearance between the rotor and the stator, and moves under line pressure into the curved space between the conical rotor and the stator. Material in this space is thrown outwardly by centrifugal force, and is combed through the small curving clearance between the rotating and stationary elongated projections or bars. This process is repeated over and over again, as the material is carried through this curved space first axially and then more and more laterally towards the periphery of the stator and the rotor, where it is discharged.

The clearance between the rotor and the stator is varied by moving the members longitudinally with respect to each other. As these members wear, they are moved towards each other to maintain the desired small clearance and refining action. From time to time, the projections or bars on the surfaces are worn down, and have to be replaced.

Such crushing and beating refiners are referred to in this art as conical refiners, and are sold throughout the world, including the U.S.A., by the Swedish company HYDROLIN AB under the trademark MOULATOR®, and by the Swedish company CELLWOOD MACHINERY AB under the trademark KRIMA M REFINER®, described in Swedish patent No. 123,232, published Nov. 9, 1948, to Aktiebolaget Defibrator.

The MOULATOR and KRIMA M conical crushing and beating refiners are shown in FIGS. 2 and 3. They have a crushing zone 20 which receives feed of coarse wood material from the grinder. The wood material enters the streamlined inlet passage 21 which, together with the helically extending bars 22 on the rotor 23, facilitate the feed of the wood material into the narrower annular space or beating zone 24 between the stator 25 and rotor 23. The coarse wood residues are crushed, pre-defibrated and softened in the passage 21 within which they are compressed while being carried forward through the tapering narrowing clearance between the stator and the rotor. In the beating zone 24, the material is defibrated and beaten between the peripheral discs 26, 27 at the ends of the stator and rotor. The discs constitute planar annular beating discs, and the treated material leaves the beating zone at the periphery thereof via the outlet 28.

Because of the relatively wide and conical configuration of the inlet 21 and the crushing zone 20, it has been found possible to charge to the conical crushing and beating refiner wood residues of considerable size.

This conical crushing and beating refiner also makes it possible to obtain effective reduction of the shives content of the pulp during its passage between the peripheral beating discs of the beating zone, since these are the same kind of beating segments as provided in conventional disc refiners. In this way, during the passage through the conical crushing and beating refiner, one can obtain a reduction in the shives and slivers content of the pulp of at least 20%.

In addition to reducing slivers and shives to free fibers, it is also possible to mechanically process the fibers obtained, i.e., to reduce and to regulate the freeness of the pulp by treatment thereof in the conical crushing and beating refiner. One may in fact reduce the freeness of the pulp suspension according to SCAN-C21:65 by at least 10 ml up to at most 500 ml during treatment in the conical crushing and beating refiner.

It has been found particularly suitable, especially when grinding under superatmospheric pressure, to maintain a constant level of the pulp suspension in the outlet zone of the grinder. This is achieved with the aid of a differential pressure sensor, which automatically controls a valve at the outlet tube of the conical crushing and beating refiner.

After grinding under superatmospheric pressure, the pressure is relieved downstream of the valve by passing the pulp suspension through a cyclone for gas separation. If grinding is carried out under normal atmospheric pressure, no venting is needed, and the pulp can be passed directly from the conical crushing and beating refiner to a screening operation, a bleaching operation, or to a paper-making operation.

The freeness of the groundwood pulp suspension leaving the grinder is measured at atmospheric pressure in an automatic freeness tester. The freeness can be measured in a small sample flow diverted from the main flow.

A satisfactory freeness tester is the Innomatic ® freeness tester, which is composed of a pair of concentric tubes arranged vertically, with inlet and drain lines at the bottom, and an outlet (by overflow) at the top. The inner tube is tapped by a side line which includes a screen plate and a measuring chamber, with a pair of electrodes arranged at different levels in the tube. Both inner and outer tubes are filled with pulp suspension. The column of pulp in the inner tube drains through the screen, and filtrate collects in the measuring chamber, and activates the electrodes in sequence as the chamber fills. The elapsed time is converted to an electric signal, which can be directed to a recorder or a computer. A cleaning cycle follows, and the device is then ready for the next cycle.

The overflow outlet line at the top returns the diverted flow of pulp to the main flow or to a chest. Sample pulp flow proceeds through the outer tube, but the inner tube taps a constant portion of the pulp flow. There is consequently a constant column head under atmospheric pressure in the inner column of pulp whose freeness is being tested, driving filtrate through the screen independent of process pressure and flow variations. There is no turbulence, because the pulp sample is isolated from the main pulp stream.

The measurements are taken after relief of pressure, such as after the cyclone, if the grinding is at superatmospheric pressure.

Preferably, the consistency of the pulp suspension is first brought to a constant level, if desired, with the aid of a pulp consistency regulating device, which in turn controls the supply of diluting water to the system. It has been found important in controlling freeness that the pulp consistency during the freeness measurement be kept constant.

The freeness also can be measured by batch sampling. After measurement the sample is returned to the main stream.

In its most preferred form, the automatic freeness tester is provided with means for continuously recording the freeness of the pulp suspension. It is also provided with a transducer for sending control signals to an electrical power-input control means in both the grinder and the conical crushing and beating refiner. It has been found possible in this way to control the freeness of the pulp suspension and to maintain the freeness at a constant level, which is registered by the recorder at the same time.

The energy input to the conical crushing and beating refiner is never permitted to exceed 800 kWh per ton of pulp produced. By setting a suitable limiting value for the freeness of said pulp it is thus possible to produce continuously groundwood pulp having substantially the same selected freeness value, with the aid of the automatic freeness tester.

The groundwood pulp may suitably be processed in a dewatering apparatus for recovering hot process water, which can then be used to advantage as shower water in the grinder. If so required, the thickened pulp can be bleached, and then finally screened. Alternatively, subsequent to thickening, the pulp can first be thinned and screened and then bleached.

In order to influence the roughness of paper prepared from the groundwood pulp, the pulp subsequent to being thickened may alternatively be passed to a conventional disc refiner, for final adjustment of its freeness. This type of treatment is known as "post-refining". When treating the pulp in this way, bleaching chemicals may also, to advantage, be mixed with the pulp flow, this process being known as "refiner-bleaching".

When grinding at superatmospheric pressures, it has also been found suitable to pass the pulp suspension leaving the conical crushing and beating refiner to a pressure screen for screening. If the pressure in the grinder exceeds 100 kPa (1 kp/cm$^2$), a pump can be saved. In this case it is also an advantage to regulate the pulp consistency upstream of the cyclone, i.e., in the line between the pressure screen and the cyclone. The pressure screen, however, may also be located downstream of the cyclone without appreciable detriment.

The following Examples represent preferred embodiments of the process according to the invention, utilizing the flow sheet of FIG. 1:

EXAMPLES 1 to 3

(1) Control 1 (prior art: atmospheric pressure grinding)

The groundwood pulp suspension from debarked spruce logs ground in a conventional atmospheric grinder having a newly sharpened grindstone was passed to a vibratory screen for removing coarse residues and slivers. The accepts pulp leaving the screen was collected in a bin. The rejects, i.e., the coarse wood residues and the slivers, were passed to a crusher, in which the wood residues and slivers were reduced to a miximum length of about 40 mm. The rejects treated in the crusher were then mixed with accepts from the vibratory screen. Samples were taken from the resultant mixture for analysis and for the manufacture of paper. Prior to manufacturing paper sheets, the pulp mixture was screened through a flat laboratory screen, in which the slot size of the screen plate was 0.15 mm. Test sheets were then manufactured from the pulp. The analysis and test results are set forth in Table I.

(2) Control 2 (prior art: superatmospheric pressure grinding)

Groundwood pulp suspension from debarked spruce logs ground in a grinder as shown in FIG. 1, operating at a super-atmospheric pressure of 100 kPa (about 1 kp/cm$^2$) and having a newly sharpened grindstone was passed to a crusher in order to reduce coarse wood residues and slivers present in the suspension to a maximum length of about 40 mm. The pulp suspension was then passed from the crusher to a cyclone for separating steam from said suspension. After separation of steam, a sample of the pulp was taken for analysis, and for the manufacture of test sheets similar to those described in Control 1. The results obtained are set forth in Table I.

(3) Example 1 (according to the invention, using the flow sheet of FIG. 1)

Pulp suspension from debarked spruce logs ground in the same pressure grinder 1 (pressure 100 kPa) as in Control 2, was passed to the conical crushing and beating refiner 2, a Krima refiner, although a Moulator refiner can also be used, in which course wood residues, slivers and shives were reduced to free fiber form. The pulp suspension in the outlet zone 1*a* of the grinder was continuously maintained at substantially the same level with the aid of the differential pressure sensor 3, controlling the outlet opening of the valve 4. The pulp suspension then passed to the cyclone 7, via the line 5, where steam 6 was separated from the suspension. The sensor 9 determined the pulp consistency, and the associated pulp consistency measuring and control unit 10 regulate the valve 11 of a diluting-water line 12, to thin the pulp suspension as necessary, so as to maintain pulp consistency constant. In Controls 1 and 2, the pulp consistency of the pulp suspension subsequent to leaving the grinder was in excess of 2%. In Example 1, however, a constant pulp consistency of 2% could be maintained by means of the automatic pulp consistency measuring and control unit 10.

A small continuous flow of the pulp suspension after adjustment to constant pulp consistency passed to an Innomatic automatic freeness tester 13, where the freeness values of the pulp suspension were continuously registered on a recorder 14. In this Example, the conical crushing and beating refiner 2 was operated with the widest possible beating clearance.

The transducer 15 controls power input to the grinder 1 and to the conical crushing and beating refiner 2 according to the freeness values, so as to maintain them within selected limits. The power load on the conical crushing and beating refiner was measured at 60 kW. At the same time, the production was found to be 2.3 tons per hour, meaning that the specific energy consumption in this test reached 26 kWh per ton of bone dry pulp produced.

The recorder 14 of the freeness tester showed a freeness value of about 220 ml. When simultaneously determining the freeness in a Canadian Standard Freeness tester in the laboratory, a value of 200 ml was obtained. The concordance between respective determinations was thus very good. Pulp samples were taken for evaluating the pulp and paper properties, the paper samples being prepared in the same manner as that described in Controls 1 and 2. The results are set forth in Table I.

(4) Example 2 (according to the invention, using the flow sheet of FIG. 1)

A further test was carried out with pulp suspension from debarked spruce logs, taken from the same grinder as in Example 1, and in the same manner as that described in said Example 1, with the exception that the power load on the conical crushing and beating refiner 2 was increased from 60 kW to 200 kW. Surprisingly, this change in load did not result in a change in the production capacity, i.e., production was maintained at 2.3 tons per hour. The specific energy consumption, however, rose in this case to 87 kWh/ton.

By reducing the beating clearance and increasing the load in the conical crushing and beating refiner, the freeness was lowered to 145 ml. A sample of the pulp was taken for test purposes, similar to the tests carried out in Example 1. The results are set forth in Table I.

(5) Example 3 (according to the invention, using the flow sheet of FIG. 1)

Pulp suspension from debarked spruce logs, taken from the same grinder as in Example 1, was subjected to a further test, which was carried out in the manner described in Examples 1 and 2 with the exception that the power load on the conical crushing and beating refiner was now raised to 300 kW. Surprisingly enough, this also failed to affect the production capacity, in spite of the fact that the beating clearance was also further reduced. The specific energy consumption was calculated to be 130 kWh/ton, and a sample of the pulp was taken for analysis and for evaluating its properties in the manner described in Example 1. The results are set forth in Table I below.

TABLE I

| | Controls | | Examples | | |
|---|---|---|---|---|---|
| | 1 | 2 | 1 | 2 | 3 |
| Energy consumption in grinder, kWh/ton | 750 | 750 | 750 | 750 | 750 |
| Energy consumption in crusher, kWh/ton | 10 | 15 | — | — | — |
| Energy consumption in conical crushing and beating refiner, kWh/ton | — | — | 26 | 87 | 130 |
| Freeness,[1] CSF, ml | 260 | 250 | 220 | 145 | 105 |
| Shives content,[1] Sommerville, % (0.15 mm) | 4.0 | 3.9 | 2.8 | 1.9 | 0.7 |
| Fiber fractionation,[1] Bauer-McNett, | | | | | |
| +20 mesh % | 11 | 21 | 22 | 24 | 24 |
| +150 mesh, % | 62 | 54 | 53 | 52 | 52 |
| −150 mesh, % | 27 | 25 | 25 | 24 | 24 |
| Tensile index,[1] Nm/g | 21 | 28 | 33 | 36 | 41 |
| Tear index,[1] $mNm^2/g$ | 3.1 | 4.8 | 5.1 | 5.3 | 5.6 |
| Apparent density,[1] $kg/m^3$ | 315 | 310 | 335 | 345 | 355 |

[1]Freeness according to SCAN-C 21:65
Shives content according to Sommerville
Fiber fractionation according to SCAN-M 6:69
Tensile and tear index and the apparent density according to SCAN-C 28:69

As seen from Table I, there is obtained in Examples 1 to 3 a surprisingly high decrease in the shives content of the pulp suspension treated in the conical crushing and beating refiner. More surprising, however, is the fact that the coarse wood residues and long slivers are reduced in that apparatus without disturbing production. Another surprising and unexpected fact is the possibility of considerably lowering the freeness of the pulp suspension by relatively moderate increases in the energy input.

A further, important advantage afforded by the method according to the invention is that it is possible to produce pulp of low freeness even when the grindstone has been newly sharpened. As seen from Table I, the strength properties of pulp of Examples 1 to 3 is surprisingly good, compared with the Controls.

EXAMPLE 4

A further comparison was made of the method according to the present invention with the prior art using a grindstone which had been in continuous operation for eight days.

(1) Control 3 (prior art: superatmospheric pressure grinding)

The groundwood pulp suspension from debarked spruce logs ground in a pressure grinder (pressure 100 kPa) having a grindstone that had been in use for eight days, was passed to a crusher, in which the wood residues and slivers present in the suspension were reduced to a maximum length of about 40 mm. The pulp suspension was then passed from the crusher to a cyclone for separating steam from said suspension. Samples were then taken from the pulp suspension for analysis and for the manufacture of paper. Prior to manufacturing paper sheets, the pulp suspension was screened through a flat laboratory screen, in which the slot size of the screen plate was 0.15 mm. Test sheets were then manufactured from the pulp. The analysis and test results are set forth in Table II.

(2) Example 4 (according to the invention, using the flow sheet of FIG. 1)

Pulp suspension from debarked spruce logs ground in the same pressure grinder 1 having a grindstone that had been in use for eight days (pressure 100 kPa) was passed to the conical crushing and beating refiner 2, in which coarse wood residues, slivers and shives were reduced to free fiber form. The pulp suspension in the outlet zone 1*a* of the grinder was continuously maintained at substantially the same level with the aid of the differential pressure sensor 3, controlling the outlet opening of the valve 4. The pulp suspension then passed to the cyclone 7, via the line 5, where steam 6 was separated from the suspension. The sensor 9 determined the pulp consistency, and the associated pulp consistency measuring and control unit 10 regulate the valve 11 of a diluting-water line 12, to thin the pulp suspension as necessary, so as to maintain pulp consistency constant. In Controls 1 and 2, the pulp consistency of the pulp suspension subsequent to leaving the grinder was in excess of 2%. In this Example, however, a constant pulp consistency of 2% could be maintained by means of the automatic pulp consistency measuring and control unit 10.

A small continuous flow of the pulp suspension after adjustment to constant pulp consistency passed to an automatic freeness tester 13, where the freeness values of the pulp suspension were continuously registered on a recorder 14. In this Example, the conical crushing and beating refiner 2 was operated with a medium beating clearance.

The transducer 15 controlled power input to the grinder 1 and the conical crushing and beating refiner 2 according to the freeness values, so as to maintain them within selected limits. The power load on the conical crushing and beating refiner was thus in this case maintained at about 160 kW. At the same time, the production was found to be about 2.3 tons per hour, meaning that the specific energy consumption in this test reached 70 kWh per ton of bone dry pulp produced.

The recorder 14 of the freeness tester showed a freeness value of about 140 ml. Pulp samples were taken for evaluating the pulp and paper properties, the paper samples being prepared in the same manner as those described in Controls 1 and 2. The results are set forth in Table II.

TABLE II

| | Control 3 | Example 4 |
|---|---|---|
| Energy consumption | | |
| in grinder, kWh/ton | 1100 | 950 |
| in crusher, kWh/ton | 15 | — |
| in conical crushing and beating refiner, kWh/ton | — | 70 |
| Freeness, CSF, ml[1] | 150 | 140 |
| Shives content, Sommerville (0.15 mm), % | 3.3 | 1.2 |
| Fiber fractionation,[1] Bauer-McNett: | | |
| +20 mesh, % | 20 | 23 |
| +150 mesh, % | 50 | 52 |
| −150 mesh, % | 30 | 25 |
| Tensile index,[1] Nm/g | 37 | 36 |
| Tear index,[1] $mNm^2/g$ | 5.4 | 5.6 |
| Apparent density,[1] $kg/m^3$ | 350 | 345 |

[1]Freeness according to SCAN-C 21:65
Shives content according to Sommerville
Fiber fractionation according to SCAN-M 6:69
Tensile and tear index and the apparent density accorrding to SCAN-C 28:69

As seen from Table 22, the total energy consumption was surprisingly about 100 kWh/ton lower in Example 4 than in Control 3. Further, Example 4 gives a groundwood pulp having a far lower shives content than Control 3. Thus, the invention enables the shives content to be reduced by practically 65%, when producing groundwood pulp with a dull grindstone, while maintaining a low energy consumption at the same time, which is an important advantage.

Having regard to the foregoing disclosure, the following is claimed as the patentable and inventive embodiments thereof:

1. A process for removing coarse wood residues and shives from aqueous groundwood pulp suspensions obtained in a grinder, which consists essentially of:

(1) passing a uniform flow of groundwood pulp suspension containing coarse wood residues and shives from the grinder to a conical crushing and beating refiner having two treatment zones, including a stationary part and a rotary part defining therebetween a confined conical crushing zone and a beating zone; and in said zones reducing coarse wood residues and shives in the suspension to free fibers (2) while measuring and controlling the freeness of the pulp within selected limits by controlling both the power input to the grinder and to the conical crushing and beating refiner and the degree of beating of the pulp; and (3) recovering from the conical crushing and beating refiner groundwood pulp having a low shives content and superior strength properties at a low energy consumption.

2. A process according to claim 1 in which the beating is controlled by adjusting the clearances between the stationary and rotary parts defining the beating zone.

3. A process according to claim 1 in which the grinding in the grinder is under superatmospheric pressure, which is maintained during the crushing and beating, and then released; and the released steam used for heating purposes or for generating electrical energy.

4. A process according to claim 1 in which the crushing and beating zones comprise an introductory conical crushing zone in which coarse wood residues and shives are successively broken up to fibrous particles of equal size, and a planar beating zone in which the fibrous particles of equal size arriving from the crushing zone are beaten to separate free fibers, the conical crushing and beating refiner comprises a stator and a rotor which define said zones therebetween, and which at their peripheral end portions merge with planar, annular beater discs having a narrowing, adjustable clearance therebetween; the rotor in the portion within the crushing zone having the form of a concave cone, having on the surface thereof helically extending bars which intermesh with similar bars on the stator surface; the crushing and beating refiner in addition having streamlined inlet passages which, together with the helically extending bars on the rotor, facilitate the feed of the wood material into the said zones.

5. A process according to claim 1 in which, in addition to reducing slivers and shives to free fibers, the freeness of the pulp is reduced in the crushing and beating zones by at least 10 ml up to at most 500 ml according to SCAN-C21:65.

6. A process according to claim 1 in which a constant level of the pulp suspension is maintained in the outlet zone of the grinder.

7. A process according to claim 1 in which the crushing and beating zones are maintained under superatmospheric pressure and pressure is relieved downstream of the zones by passing the pulp suspension through a cyclone for gas separation.

8. A process according to claim 1 in which the freeness is measured in a sample flow of pulp suspension diverted from the main flow, and after measurement is returned to the main stream.

9. A process according to claim 8 in which the pulp consistency during the freeness measurement is kept constant.

10. A process according to claim 1 in which the freeness readings operatively control a transducer controlling electrical power input to both the grinder and the conical crushing and beating refiner, thereby maintaining the freeness at a constant level.

11. A process according to claim 10 in which the energy input to the conical crushing and beating refiner is not permitted to exceed 800 kWh per ton of pulp produced.

12. A process according to claim 1 in which the groundwood pulp is processed to recover hot process water, which is recycled as shower water to the grinder.

13. A process according to claim 1 in which the content of wood residues and shives of the pulp is reduced by at least 20% during passage through the conical crushing and beating refiner.

14. Apparatus for reducing to free fibers coarse wood residues and shives present in aqueous groundwood pulp suspensions which consists essentially of:

(1) a grinder for preparing groundwood pulp from wood and comprising a grindstone;

(2) a conical crushing and beating refiner having two treatment zones with a stator and a rotor defining therebetween a confined conical crushing zone and a planar beating zone for reducing wood material present in the suspension to free fibers;

(3) means for passing uniform flow of the pulp suspension containing coarse wood residues and shives from the grinder to the conical crushing and beating refiner;

(4) means for measuring the freeness of the pulp; and (5) means for controlling the freeness of the pulp within selected limits by controlling both the power input to the grinder and to the crushing and beating refiner and the degree of beating of the pulp; and (6) means for recovering from the conical crushing and beating refiner groundwood pulp having a low shives content and superior strength properties at a low energy consumption.

15. Apparatus according to claim 14 comprising means for measuring and automatically regulating freeness of the defibrated pulp to within predetermined limits including a freeness tester operatively connected to a transducer which controls the power input to the grinder, and the power input to the conical crushing and beating refiner.

16. Apparatus according to claim 14 in which adjustments can be made in the clearance between the stator and rotor parts of the conical crushing and beating refiner to control the breaking up and beating of the coarse wood residues.

17. Apparatus according to claim 14 comprising a cyclone for releasing steam from a groundwood pulp suspension under superatmospheric pressure.

18. Apparatus according to claim 14 in which the conical crushing and beating refiner comprises a stator and a rotor which define the crushing and beating zones therebetween, and which at their peripheral end portions defining the beating zone merge with planar, annualar beater discs having a narrowing, adjustable clearance therebetween; the rotor in the portion within the crushing zone having the form of a concave cone, having on the surface thereof helically extending bars which intermesh with similar bars on the stator surface; and having streamlined inlet passages which, together with the helically extending bars on the rotor, facilitate the feed of wood material into the curshing and beating zones.

19. Apparatus according to claim 18 in which the peripheral beater discs of the beating zone are refiner discs.

20. Apparatus according to claim 14 in which the grinder comprises means for maintaining a constant level of the pulp suspension in the outlet zone of the grinder.

21. Apparatus according to claim 20 in which said means is a differential pressure sensor, which automatically controls a valve at the outlet tube of the crushing and beating refiner.

22. Apparatus according to claim 14, comprising a pulp consistency regulating device which controls the supply of diluting water to the system to maintain the pulp consistency constant during the freeness measurement.

23. Apparatus according to claim 14 comprising an automatic freeness tester with means for continuously recording the freeness of the pulp suspension, and a transducer for sending control signals to an electrical power-input control means in both the grinder and the conical crushing and beating refiner.

24. Apparatus according to claim 23 in which the freeness tester emits control pulses capable of being regulated according to a predetermined freeness-value to control freeness of the pulp.

* * * * *